US007569009B2

(12) United States Patent
Monti

(10) Patent No.: US 7,569,009 B2
(45) Date of Patent: Aug. 4, 2009

(54) STATION FOR FEEDING FLAT FOLDED TUBULAR BLANKS TO A BOXING MACHINE

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 11/940,197

(22) Filed: Nov. 14, 2007

(65) Prior Publication Data

US 2008/0119341 A1 May 22, 2008

(30) Foreign Application Priority Data

Nov. 20, 2006 (IT) ..... BO2006A0784

(51) Int. Cl.
*B31B 1/78* (2006.01)

(52) U.S. Cl. ..... 493/309; 493/313; 493/126; 493/315

(58) Field of Classification Search ..... 493/309, 493/313, 126, 123, 122, 310, 315
See application file for complete search history.

(56) References Cited

U.S. PATENT DOCUMENTS 3,739,696 A * 6/1973 Pearson ..... 493/178
4,081,945 A * 4/1978 Calvert et al. ..... 53/566
4,285,682 A * 8/1981 Moss ..... 493/316
5,127,894 A * 7/1992 Maccaferri ..... 493/316
5,531,661 A * 7/1996 Moncrief ..... 493/313
5,713,187 A * 2/1998 Peterson ..... 53/566
5,924,968 A * 7/1999 Odenthal ..... 493/309
6,669,616 B1 * 12/2003 Bierenacki et al. ..... 493/316
7,131,941 B2 * 11/2006 Makar et al. ..... 493/309
2004/0138039 A1 * 7/2004 Mazurek ..... 493/309
2007/0081884 A1 * 4/2007 Monti ..... 414/794.4
2008/0141632 A1 * 6/2008 Monti ..... 53/566

FOREIGN PATENT DOCUMENTS

GB 2171975 A * 9/1986

* cited by examiner

*Primary Examiner*—Sameh H. Tawfik
(74) *Attorney, Agent, or Firm*—William J. Sapone; Coleman Sudol Sapone P.C.

(57) ABSTRACT

A station includes a magazine containing stacks of flat folded tubular blanks arranged horizontal. Each stack is supported by openable support pad pairs. A platform moves vertically below the magazine and receives, when set at a raised loading position, one stack released by opening a lowermost pad pair. The platform is subsequently lowered, together with the stack, to a waiting position. A withdrawing arm, mounted on a slide moving horizontally, has suction cups for picking up a blank from the stack on the platform, when the platform is temporarily raised and then lowered to the waiting position. After picking up a blank from the stack, the slide and arm take the blank to box forming means of the boxing machine. When the stack on the platform runs out, the magazine releases another stack, while the stacks remaining in the magazine fall down in a sequence to lower levels, due to opening of the pad pairs.

4 Claims, 10 Drawing Sheets

FIG.10
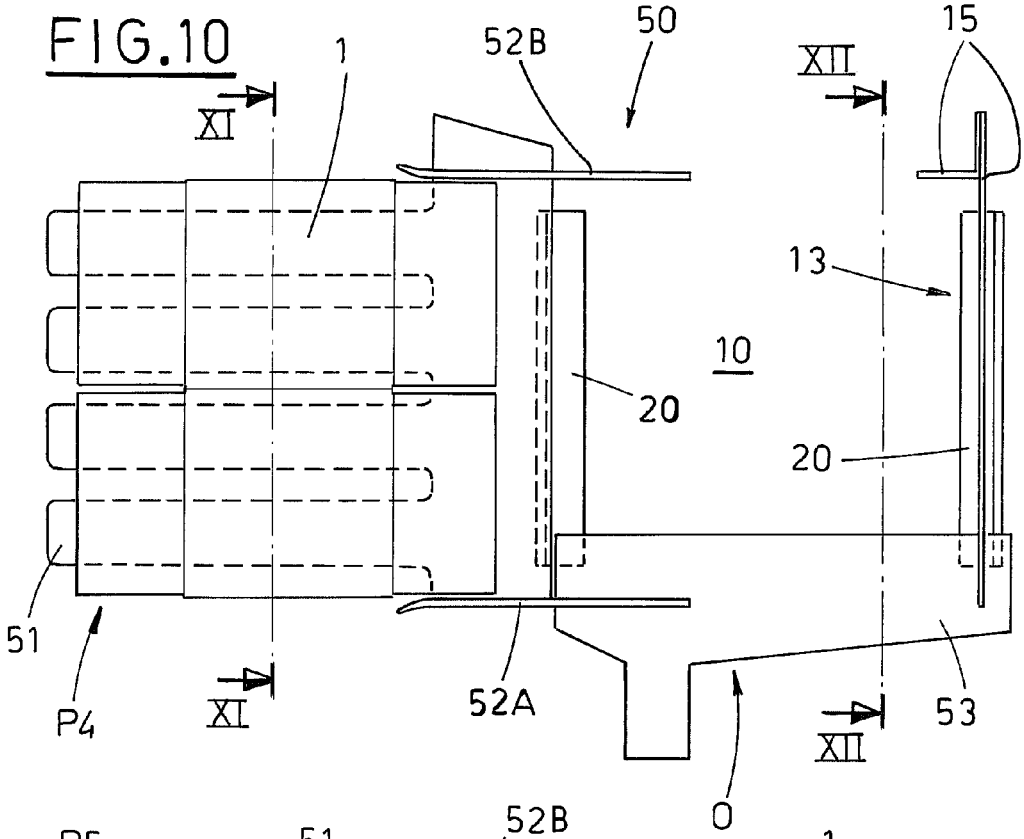
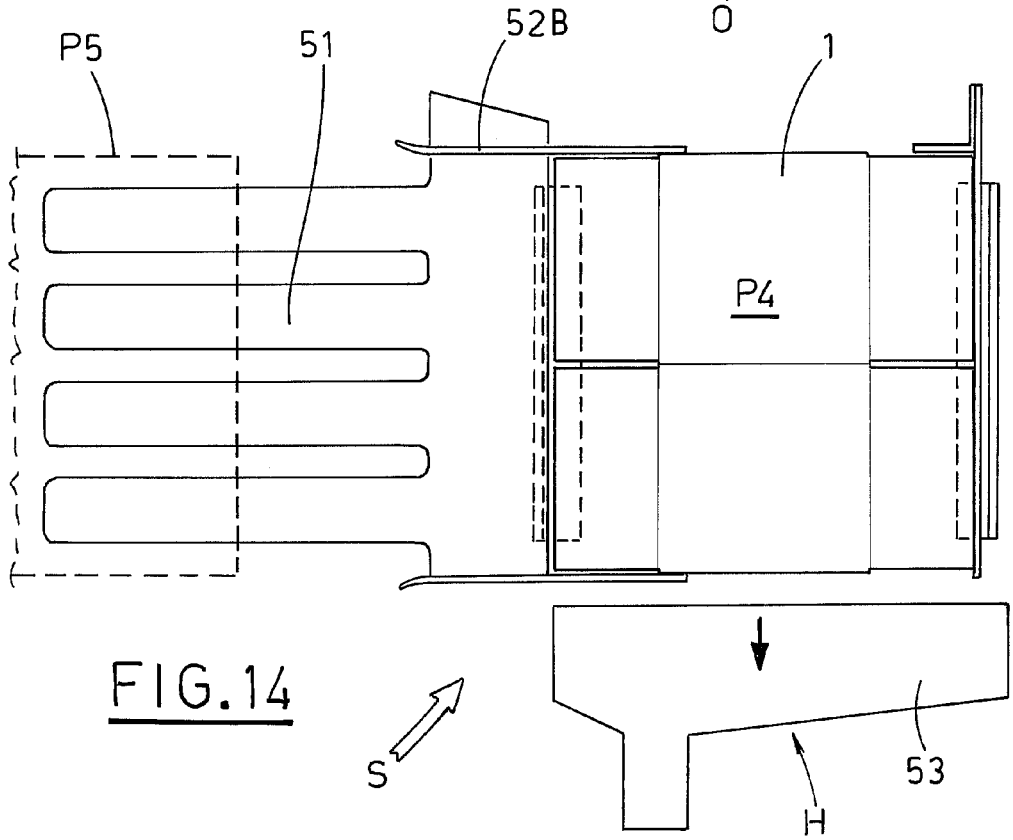
FIG.14

FIG.11
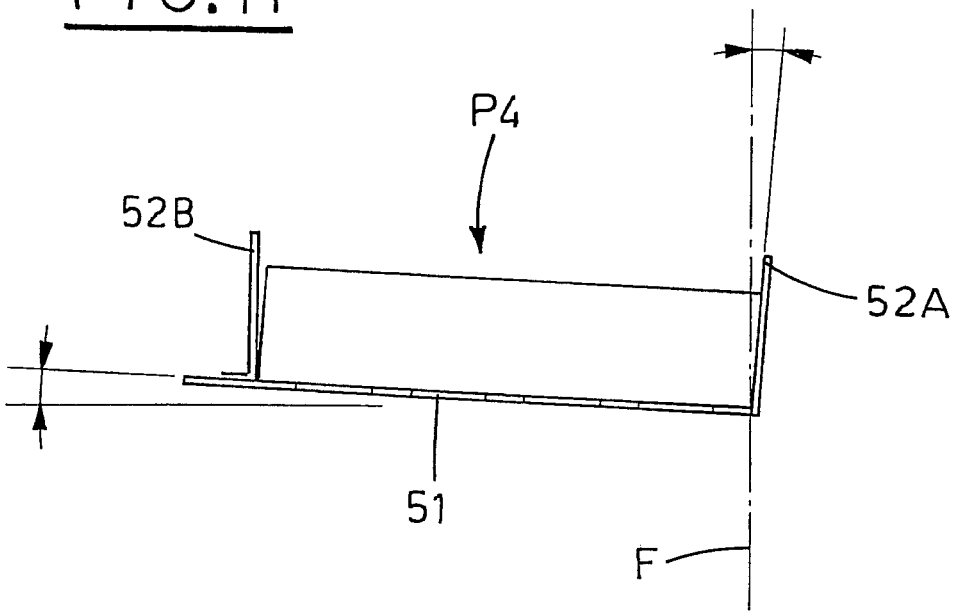
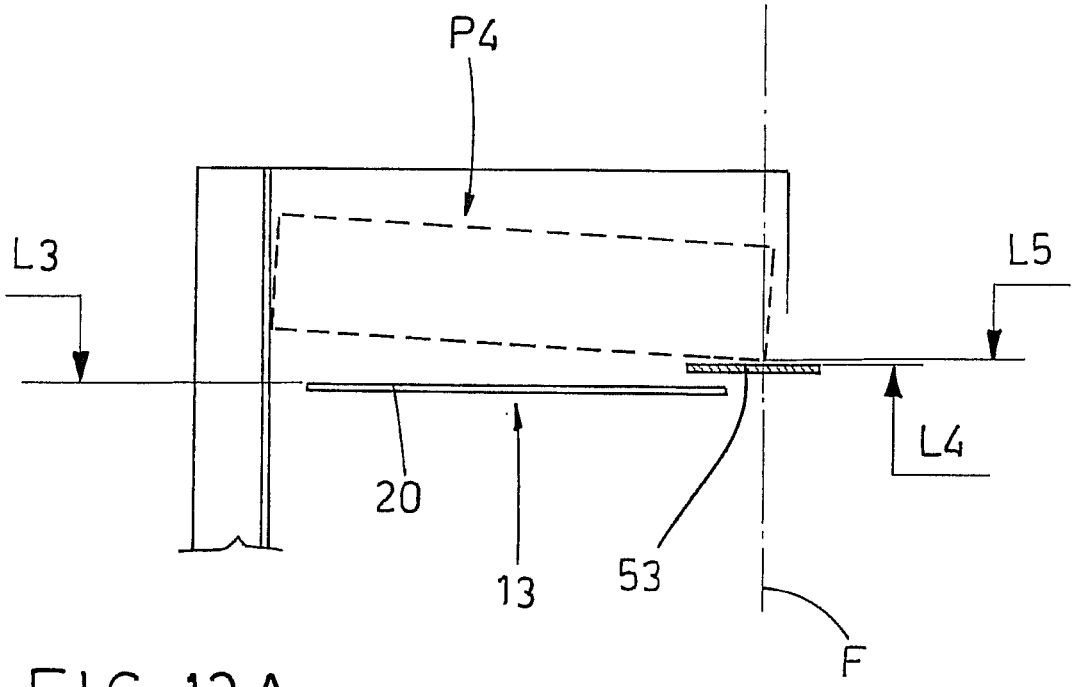
FIG.12A

STATION FOR FEEDING FLAT FOLDED TUBULAR BLANKS TO A BOXING MACHINE

FIELD OF THE INVENTION

The invention relates to the technical field concerning boxing machines, that is machines aimed at introducing a given number of articles, either in bulk or packaged, into a box made of cardboard, e.g. of canetté cardboard.

BACKGROUND OF THE INVENTION

In the above mentioned machines, the cardboard boxes are very often erected in a forming station, immediately before being introduced onto a conveying line, aimed at conveying them to subsequent filling and closing stations.

In this case, the flat folded tubular blanks, which are to form the boxes, are included in a magazine, from which the blanks are taken out one by one, by suitable means, and sent to the forming station, where they are erected by known erecting means, present therein.

There are magazines, in which the flat folded tubular blanks are arranged horizontal, or vertical, or inclined, and which have, associated thereto, withdrawing means, each time constructed in accordance with magazine conformation and with the way of feeding the forming station downstream.

The flat folded tubular blanks, when supplied by the paper-transformation industry, have a good rigidity and planarity, considered positive characteristics for automated manipulation, which make the blanks easily "machinable" articles, according to the technical jargon.

On the other hand, the same blanks weigh a lot, obviously, the bigger the blank, the bigger its weight, which is to be taken in consideration especially during the magazine designing, so as to obtain an efficient support action for a stack, big enough to permit long-lasting uninterrupted operation times, without hidering withdrawal of single blanks by the means designed for it.

An interesting known technical solution has been described in the European Patent Application EP 06121373.2, filed by the same Applicant, which discloses a "Method for withdrawing flat folded piled up articles from the open bottom of a magazine and an apparatus for carrying out such method"

According to the apparatus described in the above application, the stack of flat folded tubular blanks is inclined with respect to the vertical, and the bottommost blank is supported, at the lower side, by a horizontal conveying belt, and at the opposite, higher side, by oscillating support means.

The particular set-up of the blanks brings about the advantage that only a small part of the stack weight bears on the oscillating support means.

Said oscillating support means move between a holding configuration and a release configuration, in time relation with the operation of a blade, which is inserted between the bottommost blank and the one immediately above; in this way, the bottommost blank is released while the stack above is held.

After having been released, the bottommost blank falls onto the conveyor below, due to gravity, performing an arc oscillation, which has its center in a position corresponding to the blank lower side, and then the conveyor is operated to transfer the blank, now arranged horizontal, to a box forming station downstream.

The blanks are so suitably oriented in the magazine, that said high and low sides coincide with pre-creasing lines forming hinge joints between respective adjacent face-to-face walls; this allows, firstly, supporting the stack in the blanks maximum rigidity direction and, secondly, facilitating at the same time blade insertion, due to the rounded section of the two superimposed hinge creasing lines.

The just described technical solution has shown to be efficient and reliable in most cases, except for a case in which the section of the box to be obtained, according to the erecting plate, is a square.

In this case, in flat configuration, diagonally opposite pre-creasing lines, situated in the middle of the blank, are exactly one over another, unlike in the rectangular section case, in which they are shifted.

For this reason, the blanks are less resistant to bending; therefore the ones situtate at the bottom of the stack can lose the planarity and assume a curved downward conformation, due to the weight resting on them.

The above mentioned possibility affects negatively the functionality of the oscillating support means, which can lose the engagement with the stack, or of the moving blade, which can get stuck during insertion between two blanks.

These drawbacks are amplified with the blanks increasing dimensions, and consequently weight.

SUMMARY OF THE INVENTION

Therefore, the object of the present invention is to propose a station for feeding flat folded tubular blanks to a boxing machine, having means capable of operating in optimal way even with the blanks designed to constitute a square section boxes.

Another object of the present invention is to propose a station, in which the working means are functional and reliable even with blanks of large dimensions and heavy.

A further object of the present invention is to propose a station, capable of storing a considerable number of blanks, so as to offer a long operation autonomy.

A still further object of the present invention is to propose a magazine shaped in such a way, as to be able to change, even considerably, its capacity, to increase operation autonomy of the above mentioned station, without affecting the functionality.

A yet further object of the present invention is to propose a station including simple conceiving working means, having powered in a simple way, so as to make easier its operation, managing and control, as well as to reduce its costs.

The above mentioned objects are achieved by a station for feeding flat folded tubular blanks to a boxing machine, the station including:

a magazine for containing at least one stack of flat folded tubular blanks;

first openable support means provided in the magazine for supporting said at least one stack arranged horizontal;

a vertically moving platform situated below said magazine for receiving, when at a raised loading position, said at least one stack released by said first openable support means, said platform being subsequently lowered, together with said at least one stack, to a waiting position;

withdrawing means moving horizontally between two extreme positions, such that in a first extreme position said withdrawing means are situated above said at least one stack, resting on said platform, to pick up a topmost blank of said at least one stack in time relation with a calibrated raising of said platform followed by a lowering of said platform to said waiting position, whereas in a second position, said withdrawing means are set outside said platform, to deliver said topmost blank to forming means of the boxing machine.

BRIEF DESCRIPTION OF THE DRAWINGS

The characteristic features of the invention will become apparent from the following description of a preferred embodiment of the proposed station, in accordance with the contents of the claims and with help of the enclosed Figures, in which:

FIG. 10 is a top view of FIG. 9;

FIG. 11 is a section view, taken along the plate XI-XI of FIG. 10;

FIGS. 12A and 12B show, in a section view taken along the plate XII-XII of FIG. 10, two operation steps;

FIG. 14 is a top view of FIG. 13.

DISCLOSURE OF THE PREFERRED EMBODIMENTS

Having regard to the above Figures, reference S indicates the station proposed by the invention as a whole.

Figure 1:
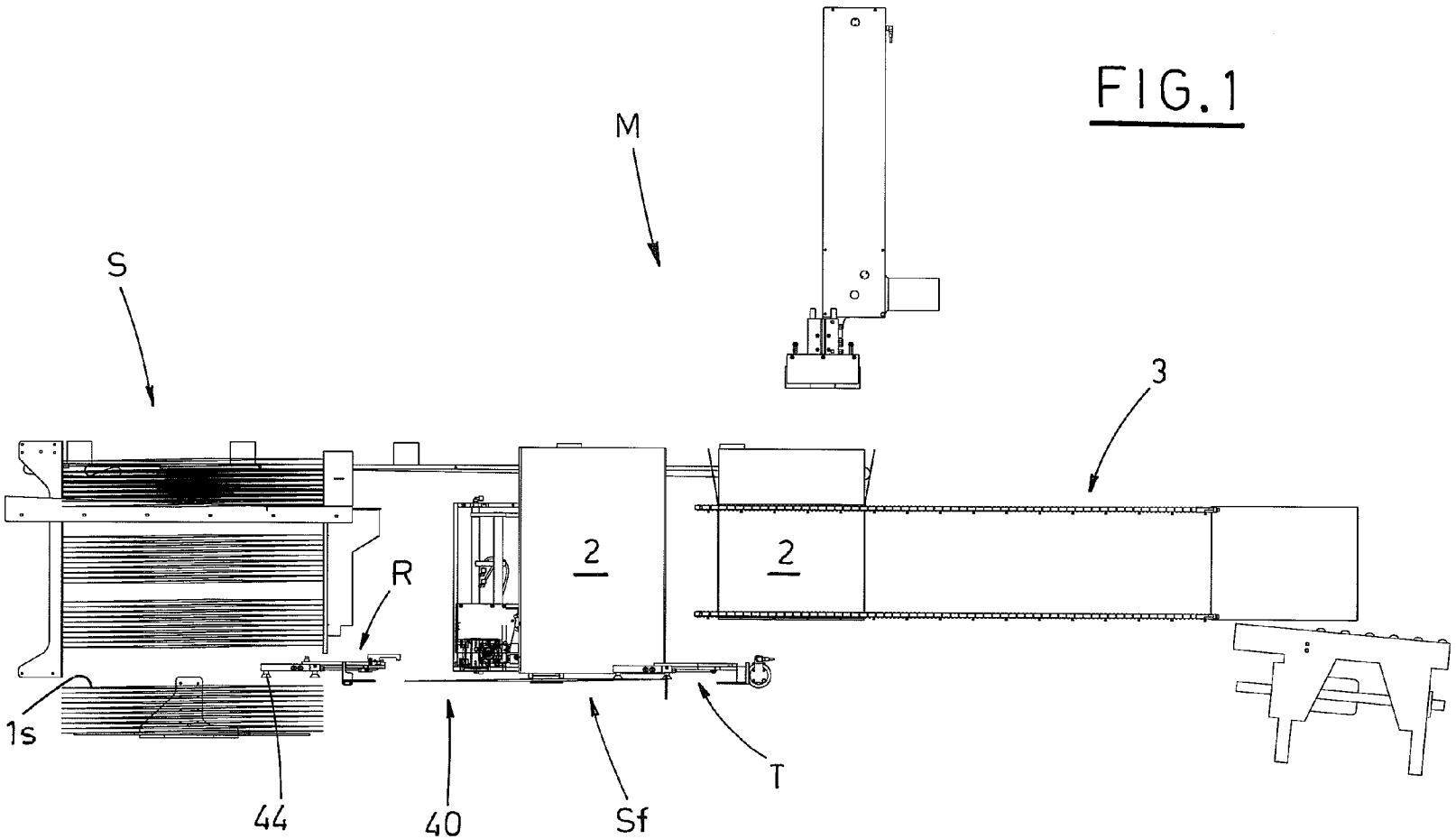
FIG. 1 is a lateral, schematic view of a known boxing machine, with the proposed station associated thereto.
Figure 2:
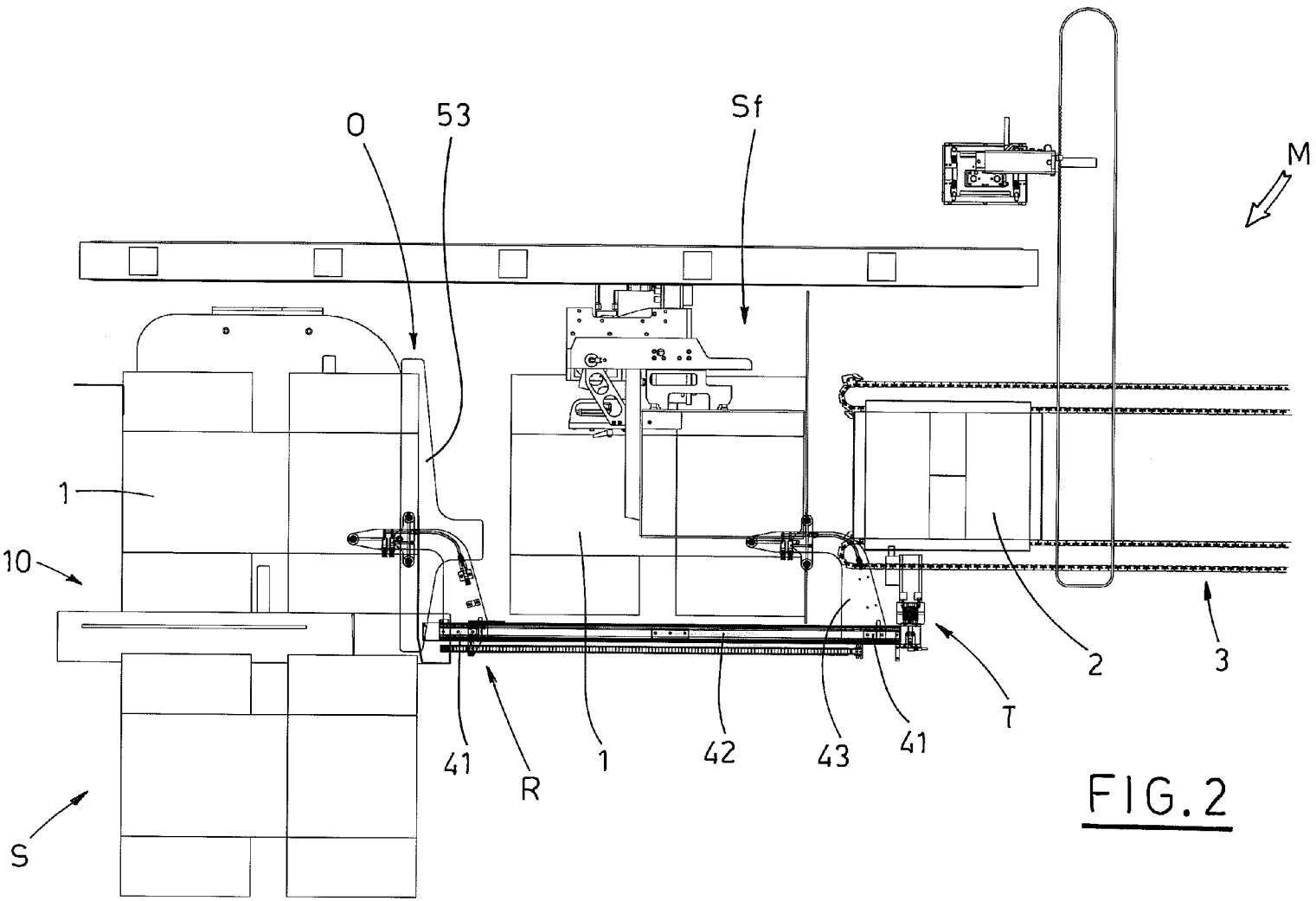
FIG. 2 is a partial, top view of FIG. 1.
Figure 3:
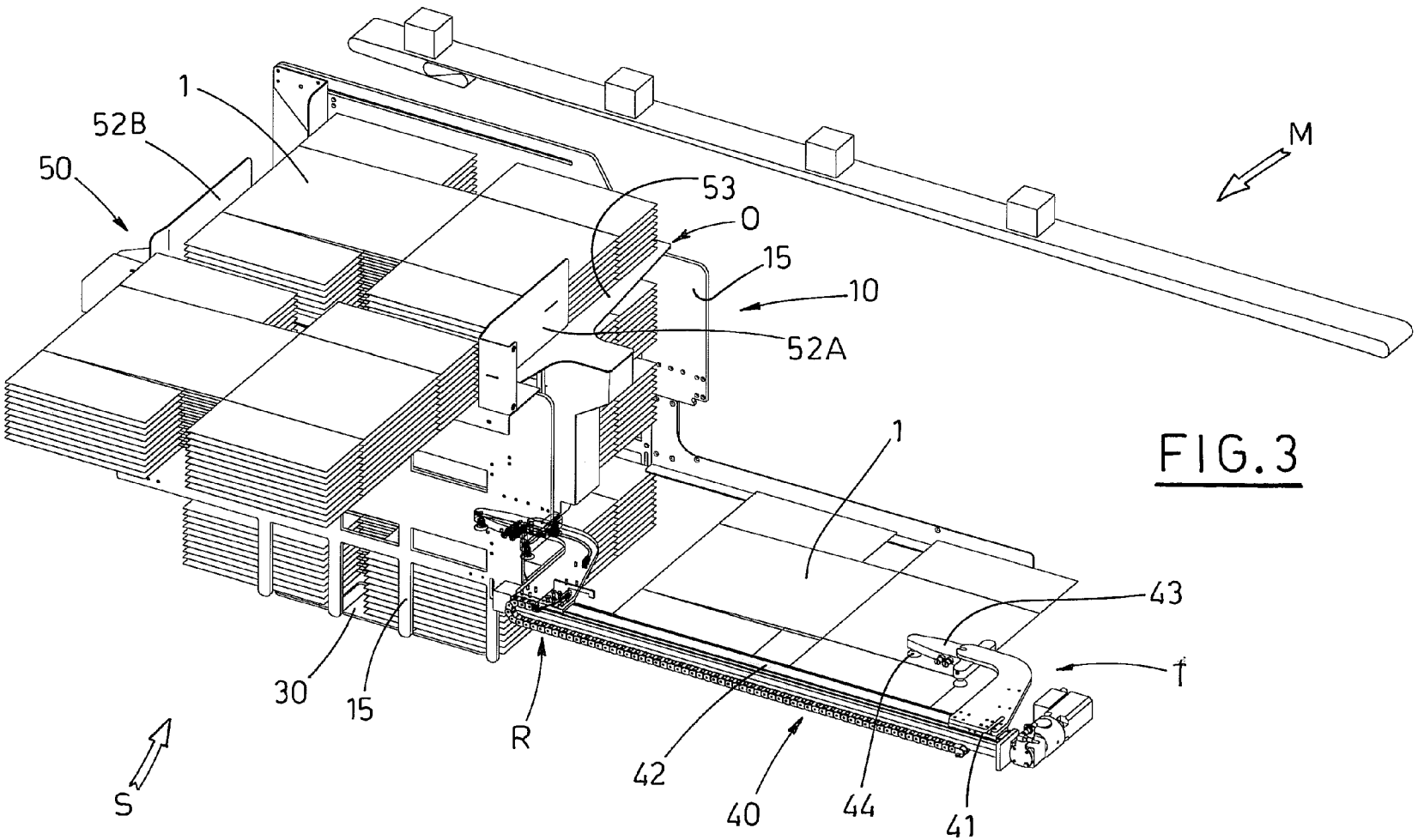
FIGS. 3 and 4 are perspective views of the proposed station, from the operator side and from the opposite side, respectively.
Figure 4:
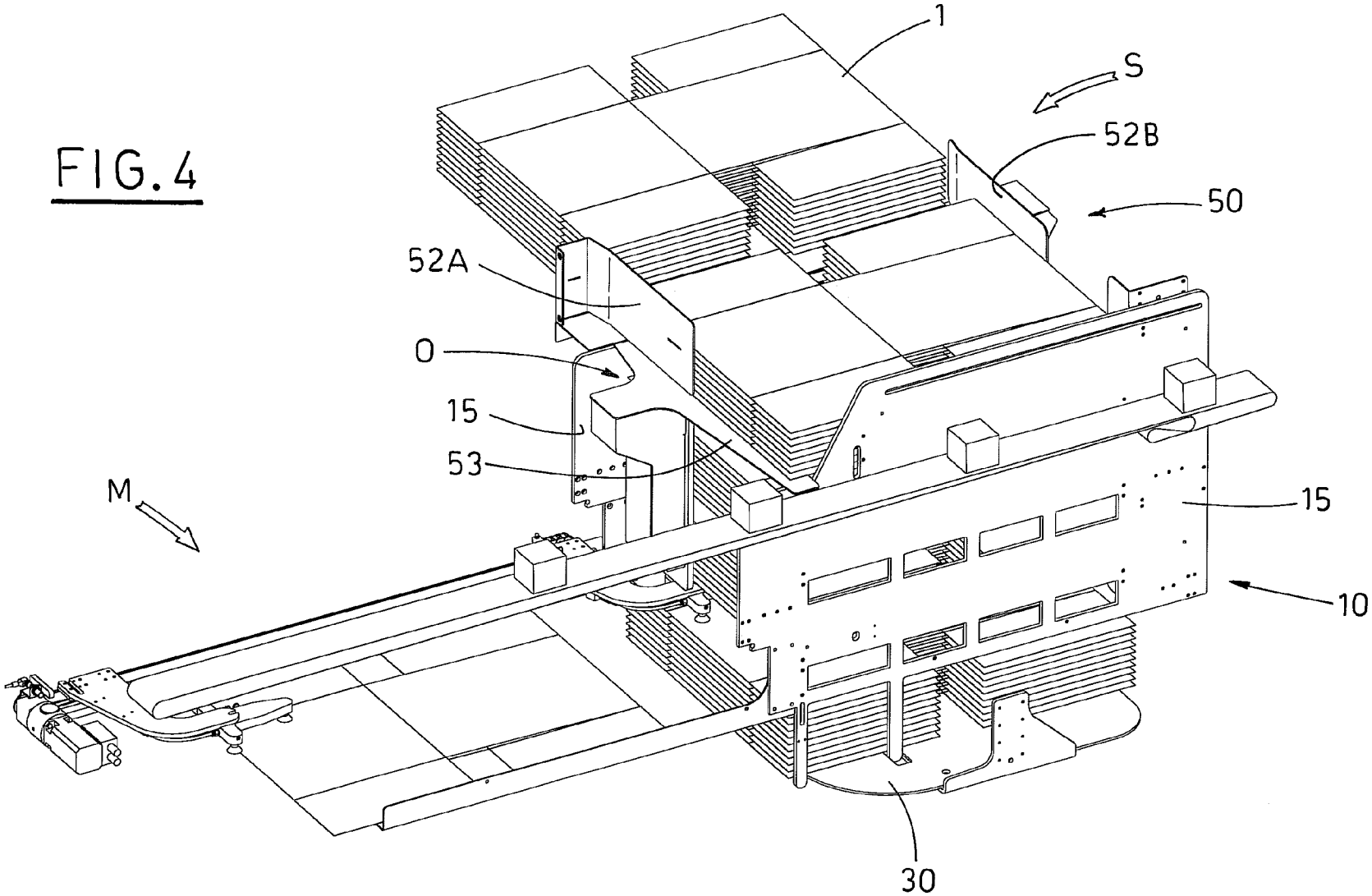

The station S is associated, for example, to a boxing machine of known type, shown partially and schematically in FIGS. 1 and 2 and indicated, in turn, with reference M.

In the above mentioned case, the station S is aimed at feeding flat folded tubular blanks 1, one by one, to a box forming station Sf, situated downstream of the machine M and aimed at erecting said blanks 1, to obtain boxes 2, which are then put on a conveying line 3, that carries them to further filling and closing stations.

The flat folded tubular blanks 1 are preferably made of canetté cardboard and are supplied by the paper-transformation industry in packs of predetermined height, usually corresponding to 150 mm.

The station S includes a deep magazine 10, aimed at containing at least a first stack P1 of blanks 1, formed by one of said packs supplied by the paper-transformation industry, suitably freed of cords or strips, with which it was tied.

The stack P1 is introduced into a deep magazine 10, with the blanks 1 arranged horizontal and placed on first, openable support means 11, situated in a position corresponding to the lower, open mouth 10A of the magazine 10.

The deep magazine 10 is delimited peripherally by walls 15, adjustable in relation to the size, according to the plan dimensions of the blanks 1 and in alignment with the fixed reference lines of the machine M.

In the example shown in the enclosed Figures, the magazine 10 extends vertically to contain, besides the first stack P1, other two stacks P2, P3, placed at subsequent, higher levels L2, L3 and supported by respective second and third openable support means 12, 13, preferably equal to the first ones.

Figure 6:
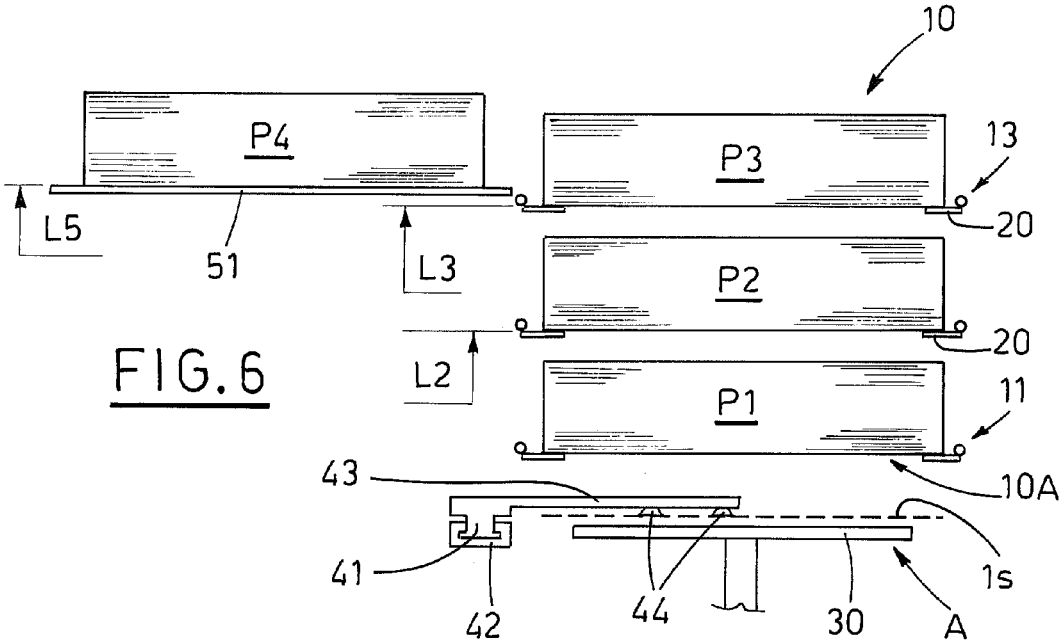
Figure 7:
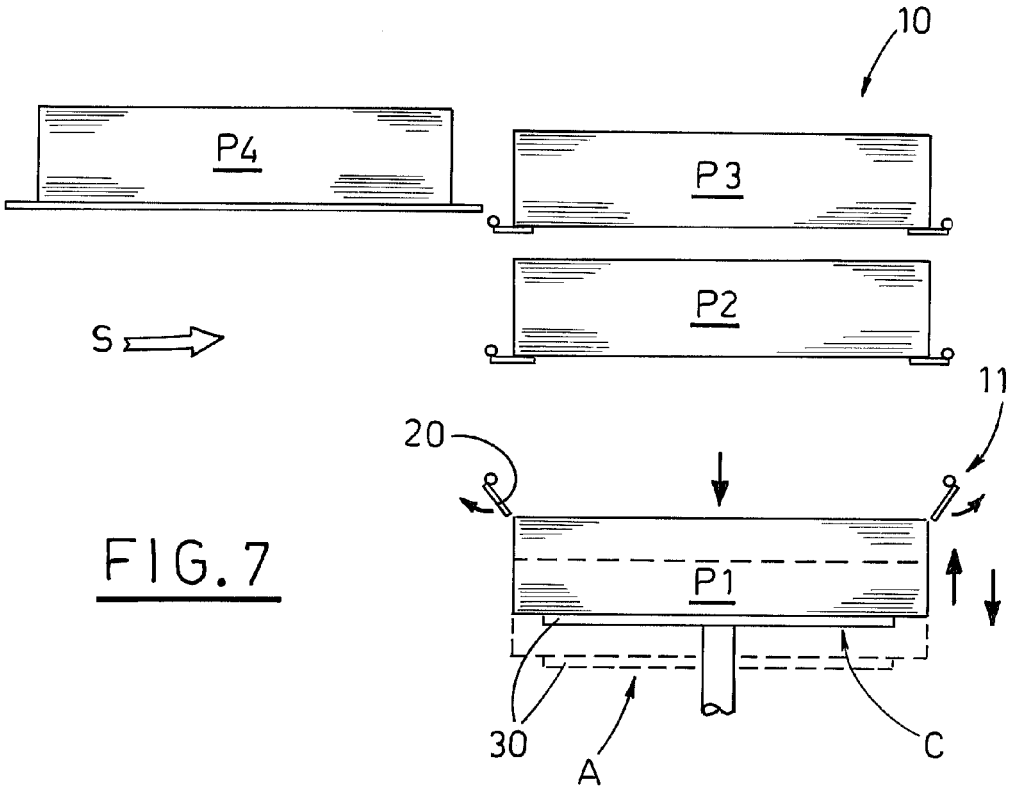
FIGS. 7, 8, 9 are the same views as FIGS. 5 and 6, of subsequent steps of reloading the withdrawing means situated in the station with a supply of blanks.
Figure 8:
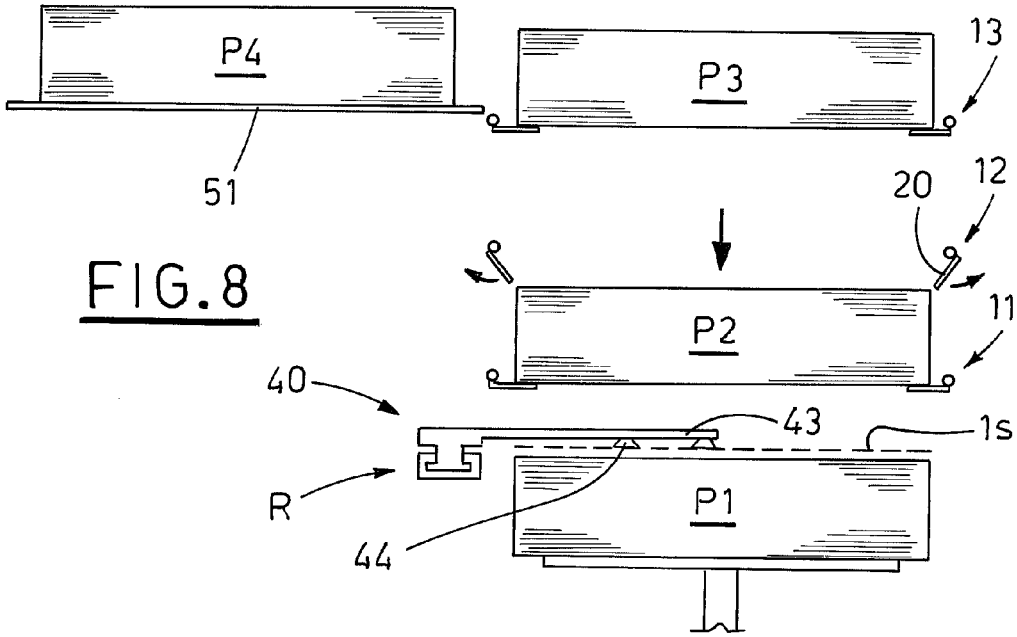

Each of said openable support means 11, 12, 13 include, a pair of opposite oscillating pads 20, moving synchronously between a horizontal position, in which they engage corresponding edges of the blank bottommost blank 1 of a relevant stack (FIGS. 5, 6), and a downward inclined position, in which the same blanks 1 are left free to fall down (FIGS. 7, 8).

With the described shape of the openable support means 11, 12, 13, the stacks P1, P2, P3 contained in the magazine 10 are mutually spaced apart, so as to leave sufficient space for the movement of the respective oscillating pads 20.

Below the deep magazine 10, there is a platform 30, made move vertically by means, not shown, for example electronically controlled, aimed at defining selected placing levels for the same platform 30, which will be better define in the part of the description concerning the operation.

The station S includes also withdrawing means 40, moving horizontally between two extreme positions R, T, in the first of which they are above the platform 30, while in the second one, they are outside the platform, in a position corresponding to the forming station Sf (FIGS. 1 and 2).

The above mentioned withdrawing means 40 include, for example, a slide 41, engaged with a guide 42, that extends horizontally between said stations S and Sf, and has a shaped arm 43, protruding cantilevered toward the area of said platform 30 and having suction cups 44, connected to a source of vacuum.

In the embodiment shown in the Figures, conveying means 50 are advantageously associated to the magazine 10 and placed above the latter for feeding stacks of blanks 1 into the magazine 10 by placing them to rest on the openable support means, situated at the higher level (with regard to the Figures, the one indicated with L3 and corresponding to the support means 13).

Figure 12B:
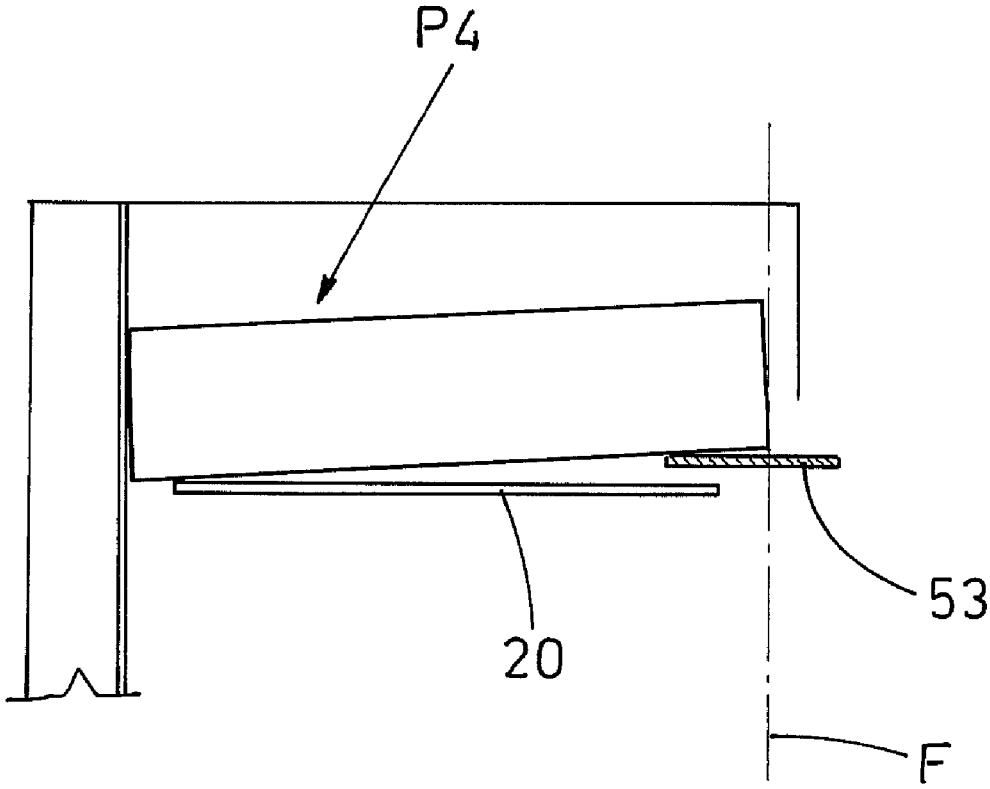

The conveying means 50 (FIGS. 3, 4, 10, 14) include, for example, a support plate 51, external to the magazine 10, situated at a level L5, suitably higher than the level L3 of the openable support means 13 (FIG. 12A), and aimed at holding at least one of said stacks of blanks 1, set in place for example manually by an operator.

The supporting plate 51 is provided with centering walls 52A, 52B, which extend up to enter partially the magazine 10 and are suitably adjustable in relation to the size, according to the dimensions of the blanks 1 and in alignment with said reference lines.

At least one retractable blade 53, aligned with the support plate 51, at a level L4, slightly lower than its level L5 (FIG. 12A), is provided in a position corresponding to an edge of said blanks 1, as an ideal extension of the support plate 51.

The retractable blade 53 is moved, by the action of an actuator, not shown, between a working position O, in which it is aimed at supporting, above the magazine 10, the stack of blanks 1, coming from the support plate 51, due to the manual action of said operator (FIG. 10), and a rest position H, in which it is external with respect to the area occupied by the same blanks 1, to allow them to enter the magazine 10 (FIG. 14), due to gravity, as it will be better described in the following.

In the shown conveying means 50, the support plate 51 and the retractable blade 53 extend perpendicular to the movement direction of the conveying line 3 of the machine M and of the slide 41; the support plate 51 is turned toward the machine side occupied by the operator, but obviously, such arrangement is not binding, because it can also be parallel to the above mentioned direction; of course, in such last case, it would be necessary to change also the arrangement of the retractable blade 53.

FIG. 11 shows a constructive peculiarity of the support plate 51, which is inclined by some degrees with respect to the horizontal, so that the stack of blanks 1, resting thereon, remains positioned at reference line F (defined by the inner surface of the adjacent centering wall 52A), situated on the side where the retractable blade 53 is situated; this inclination facilitates also the stack transferring toward the retractable blade, keeping raised the opposite side, so as to prevent the stack bottommost blanks from stumbling against the pad 20, due to their slight downward bending, (FIG. 12A).

The movement of said openable support means 11, 12, 13 of the platform 30 and of the picking up means 40, as well as the vacuum activation for the suction cups 44, are managed by the unit (not shown), which controls the machine M, so as to ensure suitable time relations.

Now, the operation of the above described station S will be described, beginning from the situation shown in FIG. 5, in which:

- the deep magazine 10 is full, with the stacks P1, P2, P3 resting oh the support means 11, 12, 13, respectively;
- a stock stack P4 is placed on the support plate 51 of the conveying means 50;
- the platform 30 is situated at a predetermined height corresponding to a waiting position A, and supports a still entire stack P of blanks 1, whose feeding mode from the magazine 10 will be described later;
- the slide 41, with the associated shaped arm 43, are in their position R, above the platform 30.

Figure 5:
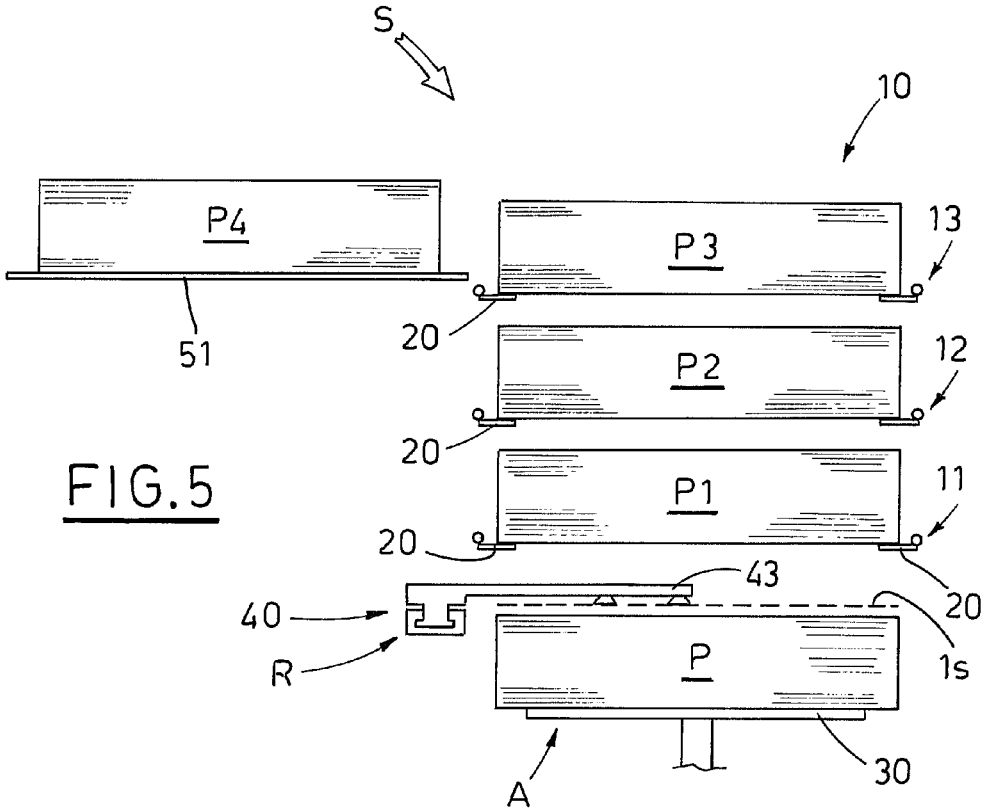
FIGS. 5 and 6 are schematic views, in vertical section, of the station in two subsequent work steps for withdrawing the blanks.

In time relation with the vacuum activation in the suction cups 44, the platform 30 performs a calibrated rise, which brings the topmost blank 1*s* of said stack P to a level, indicated with broken line in the same FIG. 5, at which it can be gripped by the suction cups 44.

After the topmost blank 1s has been gripped by the suction cups 44, the platform 30 goes down again to a waiting position A, higher than the previous one by a distance equal to the thickness of a blank; afterwards, the slide 41 is operated to perform its forward stroke toward the position T, corresponding to the box forming station Sf, in which the topmost blank 1*s* is delivered to the forming means, present therein, to be erected in order to define a box 2.

Once the blank has been delivered, the slide 41 performs the backward stroke and returns to the previous position R, to pick up the second blank 1 from the stack P, now turned into the topmost blank 1*s*.

The platform 30 performs another calibrated rise, to bring the new topmost blank 1*s* to the same level as the first one, and to place it at a level where it touches the suction cups 44; said rise is followed by a descent of the same platform 30 to a new waiting position A, further higher by a distance equal to the thickness of a blank 1, and by a subsequent forward stroke of the slide 41.

The above mentioned operations follow one another cyclically to pick up all the blanks 1 of the stack P, with a descent of the platform 30 to waiting positions A each time higher.

The picking up of the last blank 1 from the stack P is shown in FIG. 6, with the platform 30 in its waiting position A.

Otherwise, the platform 30 rise and descent steps, in which the waiting position A is raised by one-blank distance with each cycle, can be realized by a fixed waiting position A, with rises and descents increased each time by a distance equal to the thickness of a blank 1.

According to a first embodiment, not shown, during the withdrawing step, the platform 30 remains motionless in a waiting position A, and the arm 43 has suitable means for moving it vertically with descent and rise strokes of progressive length, to withdraw each time the topmost blank 1*s* from the stack resting on the platform 30.

According to a further embodiment, likewise not shown, during the withdrawing step, the platform 30 is raised cyclically by a step (equal to the blank thickness), to raise its waiting position A, keeping the topmost blank 1*s* always at the same level, from which the same blank 1*s* is withdrawn by the arm 43, having suitable means for moving it vertically with descent and rise strokes of fixed length.

When the slide 41, with the last blank of the stack P, has left the area occupied by the platform 30, the latter is raised to a loading position C, so as to receive the first stack P1, contained in the magazine 10, released by the first openable support means 11 (FIG. 7); then, the platform is lowered again to the waiting position A, related to the whole stack (broken lines in the same FIG. 7), so as to allow the slide to return to its position R.

While the slide 41, with the suction cups 44, begin again withdrawing of the topmost blank 1*s*, in cooperation with the platform 30 rise and descent, the second support means 12, in the meanwhile closed again, are operated to open, so as to allow the second stack P2 to fall down to occupy a lower position, resting on the first support means 11 (FIG. 8).

Figure 9:
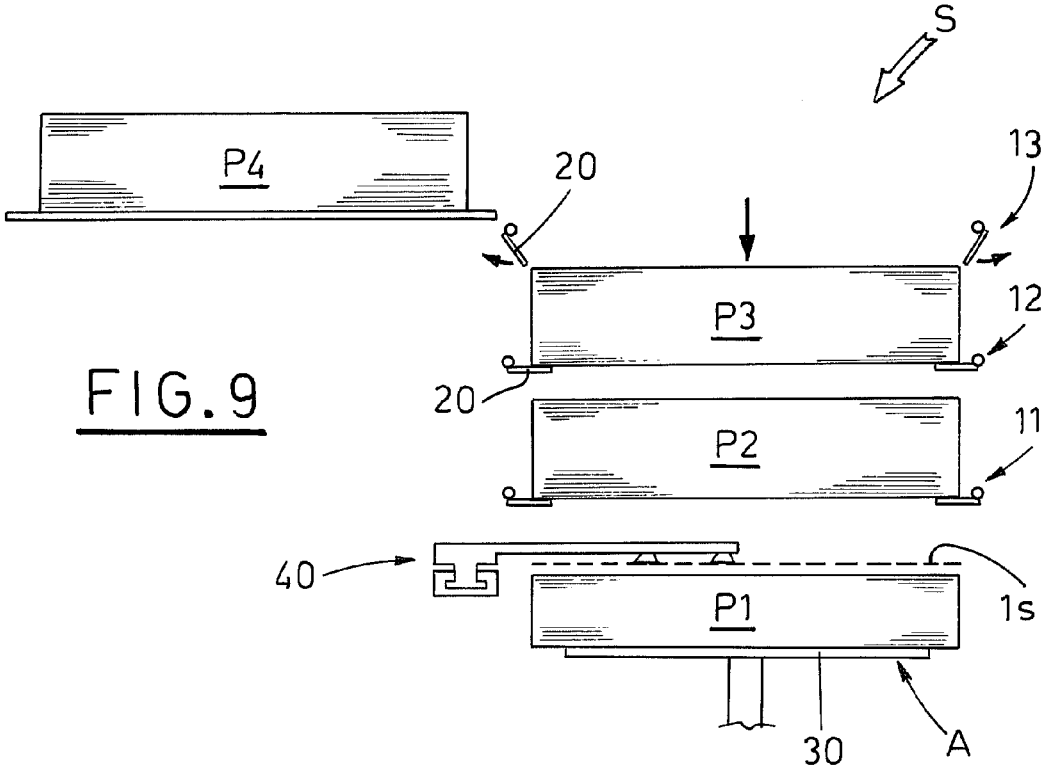

Next, the third support means 13 are operated to open, to allow the third stack P3 to fall down to rest on the second support means 12 below, in the meanwhile closed again (FIG. 9).

When this passage is completed, after the re-closing of the support means 13, the operator can act manually on, the stock stack P4 to transfer it from the support plate 51 (FIGS. 10, 11) to the retractable blade 53, arranged in its working position O (FIG. 12A). In this situation, the stack P4 is maintained by combined action of the support plate 51 and the blade 53, possibly with the help of the same operator.

When the stack P4 leaves the plate 51, it falls down with the side opposite to the blade 53, until it goes to rest onto the pads 20 situated thereunder (FIG. 12B) in the meanwhile closed again.

At this point, the blade 53 is operated to move to a rest position H, making the pile P4 fall completely into the magazine 10, to rest on the third support means 13, (FIGS. 13, 14); the command to move the blade 53 can be given directly by the operator or automatically by the machine M control unit, enabled by suitable sensor means, not shown.

Figure 13:
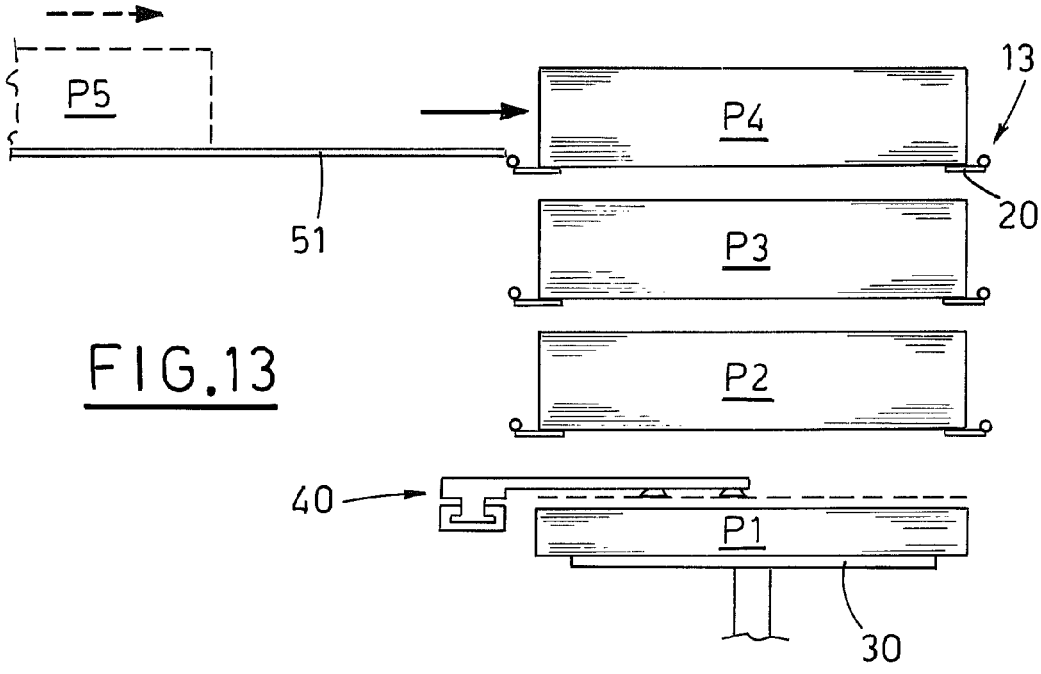
FIG. 13 is the same view as FIGS. 5, 6, 7, 8, 9, of the magazine loading step.

Later, the operator loads a new pile P5 onto the support plate 51 (indicated with broken lines in the same FIGS. 13 and 14).

The positive characteristics of the proposed station are clearly apparent from what has been said above, with said station being capable of feeding in optimal way the flat folded tubular blanks, independently from their shape and/or dimension; In particular, the conformation of the means in the station is such, that their operation does not feel the effects of the particular condition, which occurs with blanks aimed at forming a square-section boxes, mentioned in the introductory note.

Actually, unlike in the known solutions, the stack rests on a platform, and the topmost blank, which is withdrawn, is consequently in perfectly flat configuration, independently from the arrangement of the pre-creasing lines.

The layered structure of the deep magazine allows to limit the weight of each single stack to the one already predetermined by the supplying paper-transformation industry, with benefits for the operator's maneuvers, as well as for the efficiency of the support offered by the oscillating pads, giving also a long lasting operation autonomy. With such conception, the vertical extension of the magazine can be potentially unlimited, to increase autonomy as much as needed, unlike the known ones, in which all the weight of the stack rests on the lower supports.

The conveying means, associated to the deep magazine, that in the shown arrangement extend toward the area occupied by the operator, allow the latter to perform, with maximum comfort, the loading of the stacks of blanks onto the rest plate, as well as their transfer therefrom to the retractable blade. According to an embodiment, the last operation can be obviously passed on to pusher means provided for this purpose.

The opposite pads 20, defining the support means 11, 12, 13, opening in rotation, accompany downwards the relative stack $P_1$, $P_2$, $P_3$, which consequently does not break up during the descent; in this way, the space arrangement of the stack and the centering of the blanks are maintained.

The last aspect is extremely advantageous, as it simplifies considerably the conformation of the withdrawing means 40, which do not have to adjust the blank orientation at the transfer of the latter from the platform 30 to the forming station $S_f$.

All the described means are conceptually simple, and the ones powered by motor means perform simple basic operations, so as to reduce the production costs, obtaining at the same time, easy handling, as well as high precision and reliability.

However, it is understood that what above is a pure, not limiting example, therefore possible detail changes can be applied to the described means for constructive and/or functional reasons and remain within the protection scope defined by the claims below.

What is claimed is:

1. A station for feeding flat folded tubular blanks to a boxing machine, the station comprising:

a magazine for containing at least one stack of flat folded tubular blanks;

first openable support means provided in the magazine for supporting said at least one stack arranged horizontal, said first openable support means being openable for releasing said stack, such that said stack falls freely therefrom;

a vertically moving platform situated below said magazine and having a raised loading position for receiving said at least one stack released by said first openable support means, said platform being subsequently lowered, together with said at least one stack, to a waiting position;

withdrawing means moving horizontally between two extreme positions, a first extreme position in which said withdrawing means are situated between said first openable support means and said platform, below the first openable support means and above said released stack, resting on said platform, said withdrawing means picking up a topmost blank of said at least one stack in time relation with a calibrated raising of said platform followed by a lowering of said platform to said waiting position, and a second position, said second position set outside said platform, where said withdrawing means deliver said topmost blank to forming means of the boxing machine wherein said magazine contains a plurality of stacks of blanks, with a bottommost stack supported by said first support means and with remaining stacks situated at corresponding subsequent higher levels, supported by respective further openable support means, said further openable support means being opened in sequence, from bottom upwards, after said bottommost stack has been loaded onto said platform, so that each stack of remaining above stacks is transferred to an immediately lower level, so as to restore occupation of said first and subsequent openable support means.

2. A station, according to claim 1, wherein each support means, of said openable support means, includes a pair of opposite oscillating pads, moving synchronously between a horizontal position, in which they engage corresponding edges of a bottommost blank of a respective stack, and a downward inclined position, in which the blanks of said respective stack are freed.

3. A station, according to claim 2, wherein rotation opening of said pads accompanies said respective stack in a descent, thus maintaining arrangement of blanks forming said respective stack.

4. A station, according to claim 1, wherein said magazine is delimited peripherally by walls adjustable in relation to the size of the blanks forming said stacks, in alignment with reference line of the boxing machine.

* * * * *